US005329116A

United States Patent [19]

Colditz et al.

[11] Patent Number: 5,329,116

[45] Date of Patent: Jul. 12, 1994

[54] X-RAY EXAMINATION APPARATUS INCLUDING AN X-RAY IMAGE INTENSIFIER HAVING AN IMPROVED EXIT SECTION

[75] Inventors: Johannes K. E. Colditz; Willem H. Diemer; Laurens H. J. Jonk; Engelbertus Rongen; Johannes W. J. M. Scheuermann, all of Heerlen, Netherlands; Henricus M. De Vrieze, Eindhoven; August L. H. Simons, Heerlen, both of Netherlands

[73] Assignee: U.S. Philips Corporation, New York, N.Y.

[21] Appl. No.: 959,815

[22] Filed: Oct. 13, 1992

[30] Foreign Application Priority Data

Oct. 10, 1991 [EP] European Pat. Off. ..... 91202637.4

[51] Int. Cl.[5] ..... H01V 40/14

[52] U.S. Cl. ..... 250/214 VT; 313/524

[58] Field of Search ..... 250/216, 214 VT; 313/474, 524

[56] References Cited

U.S. PATENT DOCUMENTS

| | | | |
|---|---|---|---|
| 3,628,080 | 12/1971 | Lindeqvist | 315/9 |
| 3,864,037 | 2/1975 | Johnson | 250/214 VT |
| 3,987,299 | 10/1976 | Mulder | 250/214 VT |
| 4,096,381 | 6/1978 | Brown | 250/214 VT |
| 4,353,005 | 10/1982 | Van Tongeren et al. | 313/371 |
| 4,550,251 | 10/1985 | Zitelli et al. | 250/213 VT |
| 4,634,926 | 1/1987 | Vriens et al. | 313/474 |
| 4,809,309 | 2/1989 | Beekmans | 378/99 |
| 4,829,569 | 6/1989 | Dallin | 250/214 VT |
| 4,831,249 | 5/1989 | Van Der Velden et al. | 250/213 VT |

*Primary Examiner*—David C. Nelms
*Attorney, Agent, or Firm*—Jack D. Slobod

[57] ABSTRACT

An exit section of an X-ray image intensifier tube, including an the exit phosphor screen, exit window and basic optical system, is optimized so as to achieve a high light yield, low optical aberration and a high resolution. The exit window notably has a pre-compensation geometry for curvature of the image plane of the basic optical system, or the exit window an interference filter, or the exit phosphor layer contains a layer of a comparatively slow phosphor in addition to a layer of a customary phosphor in order to achieve noise-suppressing image integration.

14 Claims, 1 Drawing Sheet

X-RAY EXAMINATION APPARATUS INCLUDING AN X-RAY IMAGE INTENSIFIER HAVING AN IMPROVED EXIT SECTION

BACKGROUND OF THE INVENTION

1. Field of the Invention

The invention relates to an X-ray examination apparatus, including an X-ray image intensifier tube provided with an entrance screen with a photocathode, an electron-optical imaging system, and an exit section with an exit window, an exit phosphor screen, and a light-optical image transfer system.

2. Description of the Related Art

An X-ray examination apparatus of this kind is known from U.S. Pat. No. 4,809,309.

In a system described therein, the image transfer in the exit section often gives rise to the loss of a comparatively large part of the luminescent light to be generated in an exit screen. As a result, the brightness of an image-carrying light beam at the area of a subsequent image recording system, for example a television pick-up tube, a CCD camera, a film foil etc. is usually too low for optimum imaging. This situation can usually be improved only by way of an undesirable increase of the radiation dose in the imaging X-ray beam.

Various means have been proposed for improvement, but the gain in respect of light yield is then at the expense of a loss in respect of another property of the image transfer between the incident photoelectron beam and the recording system, for example resolution, optical imaging etc.

SUMMARY OF THE INVENTION

It is an object of the invention to provide an integrally improved exit section of an X-ray image intensifier tube, in which a gain in respect of a chosen property does not lead to a loss in respect of one or more other properties. To achieve this, an X-ray examination apparatus of the kind set forth in accordance with the invention is characterized in that the exit section is operative to form a light -strong high-resolution image-carrying light beam with few optical aberrations.

Because the exit section is integrally optimized in an X-ray examination apparatus in accordance with the invention, it is prevented that a gain in respect of light yield gives rise to a loss in respect of, for example the image transfer due to geometrical image artefacts, undesirable light reflections, light gradients between media having different refractive indices, or to a loss in respect of resolution.

In a preferred embodiment, an object plane of an exit window of the X-ray image intensifier tube exhibits a precompensating image plane curvature for a subsequent optical image transfer system. Any resultant optical aberrations are then compensated for by adaptation in the optical system itself, or the exit window is constructed as a fibre-optical plate, so that an exit side thereof acts as an object plane for, for example the basic optical system, its curvature not contributing to the lens effect of the primary imaging by the optical system. In a fibre-optical window of this kind, a curvature can be imparted to the entrance side, being a carrier for the exit phosphor screen, which curvature is adapted to the curvature, if any, of the object plane of the electron-optical system of the X-ray image intensifier tube. The shape of the inner surface and the properties of the electron-optical system can then be optimized in an integrated manner. The exit window can be constructed so as to be comparatively thick in order to reduce disturbing halo effects. The use of a halo-reducing thick window, specifically as an exit window, is known per se from U.S. Pat. No. 4,353,005. As has already been stated, a curvature can be imparted to the exit side of the window so to precompensate for image field curvature of the optical system. A precompensating curvature can also be applied by providing a glass plate, exhibiting the correct curvature, as a replica of the optical system on the outer side of the exit window. When this plate is provided on the exit window by way of optical cement, loss of light due to additional reflection or refractive index gradients is avoided.

In a further preferred embodiment, an interference filter is provided on the outer side of the exit window. Because light incident at excessive angles is then reflected, improvement of the MTF is possible without giving rise to a loss in response of light yield, because the light incident at an excessively oblique angle is reflected again so that it partly contributes to the imaging again. The exit window is formed notably as a fibre-optical plate, on the outer side of which there is provided an interference filter. When the interference filter is arranged on the outer side of the window, its inner side remains free for adaptation to the electron-optical system, etc.

The effective light yield in an ultimate image can also be increased by means of an interference filter provided on the inner side of the exit window, i.e. between the exit phosphor layer and the window.

It is to be noted that an interference filter for selection of light which is incident within a given angular range is known for the purpose of imaging from U.S. Pat. No. 4,634,926. Further technical details of such an interference filter are disclosed therein.

The light yield of the exit screen can also be increased by using an optically suitably dense metal backing layer. To this end, the metal backing layer is customarily constructed so as to be comparatively thick. However, such a thickness has the drawback that more photoelectrons do not contribute to imaging due to absorption in the layer. In order to avoid such a loss, in a preferred embodiment the usually aluminium metal backing layer is not provided by vapour-deposition, but by a deposition technique resulting in a layer of denser packing, for example by sputtering or CVD.

In addition to an optically dense metal backing layer for optimum reflection of light generated in the phosphor layer, a dense layer also has an attractive function as a chemical shielding layer for shielding the phosphor layer against notably alkalis from the entrance screen of the tube. Such chemical shielding can also be realised by means of a layer of material especially adapted for this purpose. Because such a layer need not necessarily be reflective, a high degree of freedom exists as regards the choice of the material, which benefits the optimization in respect of density and electron transparency. A suitable material in this respect is, for example aluminium oxide which is preferably deposited again by sputtering or CVD so as to achieve a dense packing.

Use can also be made of the optically transparent layers which are described in U.S. Pat. No. 4,831,249 and which can be provided, for example also between the phosphor layer and the metal backing layer. Thus, a flatter substrate layer can be realized for the metal backing layer and the metal backing layer itself can be constructed so as to be thinner again. A thickness variation in, for example the radical direction can be imparted to such a shielding layer or metal backing layer so as to optimize the local light intensity homogeneity in the emanating image-carrying light beam and to compensate for, for example electron-optical deviations occurring therein.

In a further preferred embodiment, in which the exit phosphor screen whether or not provided on a substrate is optically coupled to an inner surface of the exit window, the exit window constitutes an optical component of the light-optical image transfer system. The number of gradients in the refractive index, and hence the loss of light, can thus be reduced. The exit window notably forms a concave-flat lens, in the concave part of which there is provided the exit phosphor screen, an input lens of a subsequent image transfer system, i.e. a basic lens system, being cemented to its flat side. In addition to optimum light transfer, a rigid connection is thus obtained between the exit screen and the optical transfer system, so that optical aberrations due to non-exact optical positioning, for example relative to the optical axis of the assembly, are avoided. The otherwise necessary postfocusing of the optical transfer system onto the phosphor exit screen is thus also avoided. Moreover, defocusing due to atmospheric pressure variations, temperature fluctuations and the like is also precluded.

In another preferred embodiment, the exit phosphor screen comprises two sub-layers, a first sub-layer thereof which is situated near the exit window exhibiting a comparatively long afterglow. When for a second phosphor sub-layer, being situated further from the exit window and composed of a phosphor having a customary or comparatively short afterglow, a thickness is chosen which is adapted to a high voltage to be applied, a choice can be made between an exit image having a comparatively short (or customary) afterglow and an exit image which is desired for noise integration and which has a comparatively long afterglow, said choice being made possible by high-voltage variation. A noise integration desired because of the nature or the processing of the diagnostic imaging can thus be realised merely by high-voltage variation in the X-ray image intensifier tube itself. Such noise integration is not at the expense of a loss of light. Activation of an exit phosphor layer having a long afterglow is notably coupled to a read-out via a non-integrating read-out system such as a CCD camera.

BRIEF DESCRIPTION OF THE DRAWING

Preferred embodiments in accordance with the invention will be described in detail hereinafter with reference to the drawing. Therein.

DETAILED DESCRIPTION OF THE PREFERRED EMBODIMENTS

Figure 1:
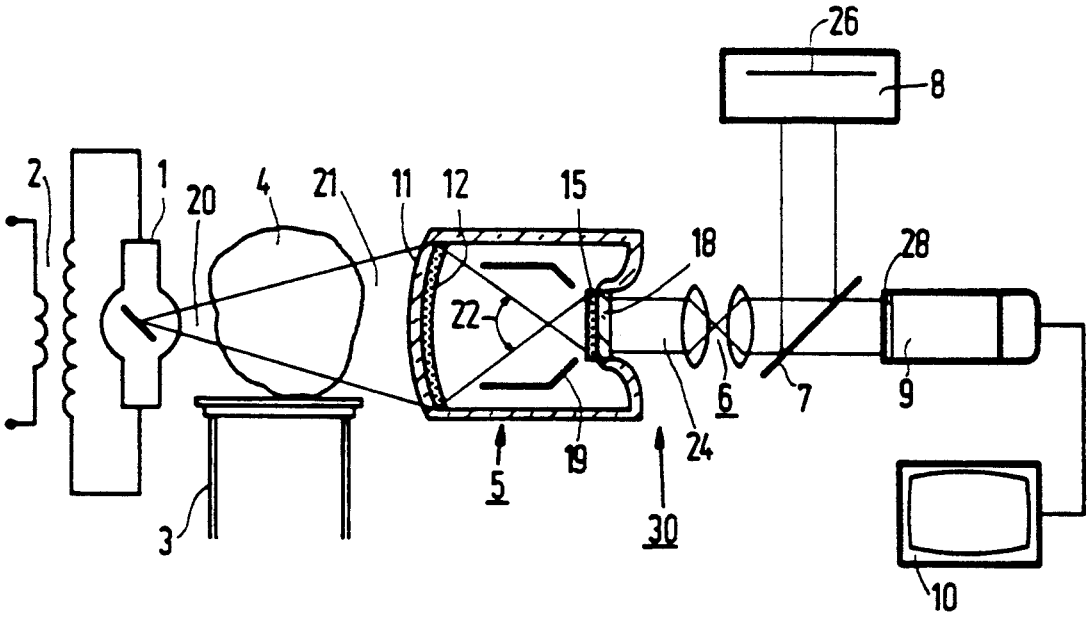
FIG. 1 shows an X-ray examination apparatus in accordance with the invention.

The drawing shows an X-ray source 1 with a power supply 2, a patient support 3 for a patient or object 4 to be examined, an X-ray image intensifier tube 5, a basic objective system 6, a semi-transparent mirror 7, a film camera 8, a television pick-up tube 9, and a television monitor 10 of an X-ray examination system. The X-ray image intensifier tube 5 comprises an entrance window 11, an entrance screen 12 with a luminescent layer 13, preferably made of CsI, and a photocathode 14 and an exit screen 15. The X-ray image intensifier tube also comprises an electron-optical system 16 which includes, in addition to the entrance screen 12 and the exit screen 15 which is preferably provided on an inner side of an exit window 18, an electron-optical system 19 which comprises one or more intermediate electrodes which are not separately shown. An incident X-ray beam 20 irradiates a part of a patient to be examined. An image carrying X-ray beam 21 transmitted thereby is incident on the entrance screen 12. The X-ray beam 21 incident on the entrance screen is converted in the entrance screen into an image-carrying beam 22 of photoelectrons which are accelerated to, for example 25 kV so as to be imaged on the exit screen 15. An image-carrying light beam 24, formed in the exit screen 15, leaves the image intensifier tube via the exit window 18. This light beam is used to expose, as desired, a photographic plate 26 in the camera 8 or a target 28 of the television pick-up tube 9.

According to the present invention, an output section 30 comprises the exit screen 15, the exit window 18 and the basic optical system 6.

Figures 2A, 2B, 2C, 2D, 2E:
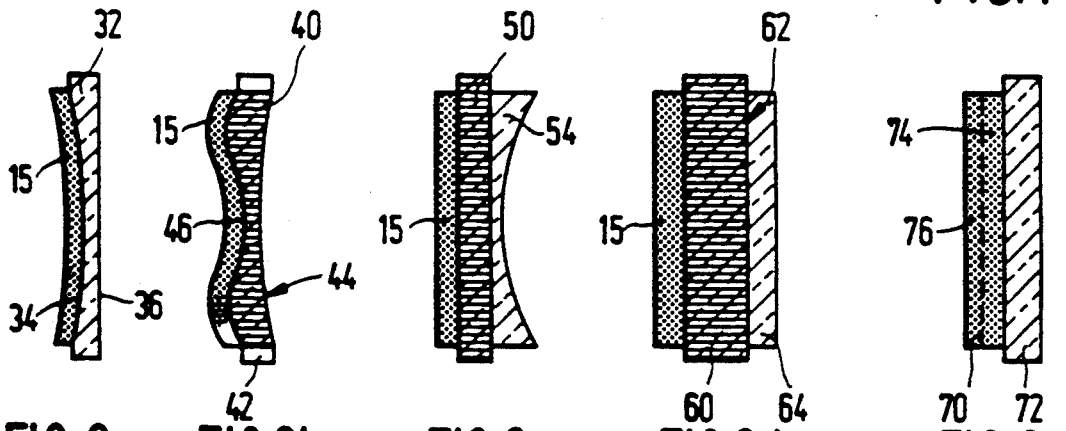
FIGS. 2*a* through 2*e* show different assemblies of exit screens and exit windows for said X-ray examination apparatus.

FIG. 2*a* shows an exit window 32 which acts as a support for the exit screen 15. The exit window 32 is preferably made of glass and its side 34 which supports the exit screen 15 is concave. Such a concave shape enables the realisation of an optimum image plane for the imaging of the photoelectron beam; it can also serve to compensate for image plane deviations of the basic optical system. If the concave shape leads to a shape of the exit window which is less suitable from a lens-optical point of view, compensation can be achieved by way of the exit surface 36 of the exit window which is shown to be flat in the drawing. Thus, an optimum concave shape for the focusing of the photoelectrons can always be combined with an optimum object plane for the basic optical system.

FIG. 2*b* shows a fibre-optical exit window 40 which is in this case accommodated in a glass ring 42, an outer end face 44 being curved for adaptation to the imaging properties of the basic optical system. It is to be noted that in a fibre-optical window of this kind the exit face 44 serves as the object plane for the subsequent optical system. This also allows for a curvature of an inner surface 46 so as to achieve optimum photoelectron imaging.

FIG. 2*e* shows an exit window 50 which is in this case a fibre-optical window but which may also consist of a homogeneous glass, an optical replica 54 being cemented to an outer side 52 of said window in order to compensate for known aberrations in the imaging properties of the basic optical system. The advantage of a separate replica consists in that the X-ray image intensifier tube and the basic optical system remain universally usable and that adapted precompensation can be achieved by means of the replica and the known imaging properties of the basic optical system.

FIG. 2*d* shows an exit window 60 which is constructed as a fibre-optical window, an interference filter 64 being mounted on an outer side 62 thereof. As is known, such as interference filter may consist of very many layers and is capable of reflecting light emanating from the window at an angle exceeding a given value.

Due to subsequent reflection in the phosphor layer 15, this light will at least partly contribute to imaging again. Thus, a higher light intensity can be achieved (within the numerical aperture of the basic lens system) without incurring a substantial loss of resolution. Using an interference filter mounted between the output phosphor and the exit window, a similar effect can be achieved because light emerging from the phosphor layer at an excessive angle is reflected so that it can be used again.

FIG. 2*e* shows an exit screen 70 arranged on an exit window 72 for which each of the previously described windows or an arbitrary other window, can be used, an anti-halo thick window. The exit screen 70 comprises two sub-layers. A first sub-layer 74 consists of a phosphor having a comparatively long afterglow, enabling internal image integration over a comparatively long period of time so that a substantial noise reduction can be achieved. A second sub-layer 76 consists of a phosphor having a customary or comparatively short afterglow, so that image integration takes place over a comparatively short period of time and a comparatively high resolution can be achieved. A choice between the two integration times for imaging can be made by variation of the photoelectron speed.

Figure 3:
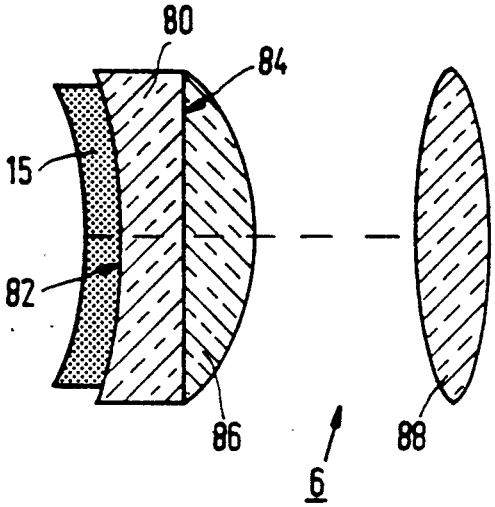
FIG. 3 shows an embodiment of an exit window, which is optically coupled to a first lens of a relevant basic optical system.

FIG. 3 shows an exit window 80, comprising a phosphor layer 15, deposited in a concave part of an inner surface 82 and a lens 86 which is provided on a flat outer side 84 and which constitutes a first lens of the basic optical system 6. A curvature of a supporting face 88 as desired for the photoelectron optical system can thus be combined, also when use is made of a homogeneous glass window, with an optimum object plane for the basic optical system. Because no clearance is present between the exit window and a first lens of the basic optical system, optimum focusing and correct rigid mounting are ensured. The exit window 80 also constitutes, in conjunction with the lens 86, a comparatively thick exit window so that the occurrence of halo phenomena in the exit image is also avoided. Such a construction combines optimum image transfer with high light yield. The latter is achieved because gradients are avoided in the coupling of the exit window to a first lens of the basic optical system and also because use is made of homogeneous glass in which the loss of light is substantially smaller than in a fibre-optical system. A second lens 88 completes the basic optical system 6 whereby the desired images can be formed in a customary manner.

We claim:

1. An X-ray examination apparatus comprising an X-ray image intensifier tube, including an exit window means which has a curvature on an outer side and an exit screen optically coupled to an inner side, and a light-optical image transfer system outside said image intensifier tube at a position, spaced from said exit window means, for receiving light output from said exit screen via said exit window means, wherein said exit screen, exit window means and light-optical image transfer system together are an exit section that is operative to form the light output from said exit screen into a substantially aberration-free image-carrying light beam.

2. An X-ray examination apparatus as claimed in claim 1, wherein said curvature is convex.

3. An X-ray examination apparatus as claimed in claim 2, wherein said exit window means has a concave curvature on said inner side.

4. An X-ray examination apparatus as claimed in claim 1, wherein said exit window means comprises an exit window having opposed first and second surfaces, and a retical having opposed third and fourth surfaces, the first surface being said inner surface of the exit window means said second and third surfaces being flat and being secured together, and said fourth surface being said outer surface of said exit window means.

5. An X-ray examination apparatus as claimed in claim 4, wherein said curvature is convex.

6. An X-ray examination apparatus as claimed in claim 5, wherein said exit window means has a concave curvature on said inner side.

7. An X-ray examination apparatus as claimed in claim 3, wherein said second and third surfaces are secured together by adhesive.

8. An X-ray examination apparatus as claimed in claim 7, wherein said curvature is convex.

9. An X-ray examination apparatus as claimed in claim 8, wherein said exit window means has a concave curvature on said inner side.

10. An X-ray examination apparatus as claimed in claim 1, wherein the exit screen comprises two successive phosphor layers, one of which exhibits a customary or comparatively short afterglow and being activatable by way of an increased potential difference between a photocathode of the image intensifier tube and the exit screen.

11. An X-ray examination apparatus as claimed in claim 1, wherein the exit screen comprises a phosphor layer having a comparatively short afterglow and further comprising a non-integrating read-out system for reading out said phosphor layer.

12. An X-ray examination system as claimed in claim 1, wherein on said inner side of the exit screen there is provided a chemical shielding layer.

13. An X-ray examination apparatus as claimed in claim 12, wherein said chemical shielding layer has a thickness varying in a radial direction.

14. An X-ray examination apparatus as claimed in claim 1, characterized in that a surface constituting an object plane is provided in a replica coupled to the exit window.

* * * * *